United States Patent [19]

Allard

[11] Patent Number: 4,512,612

[45] Date of Patent: Apr. 23, 1985

[54] SYSTEM FOR MOUNTING TOOTH-CARRIER SECTORS ON A CUTTER WHEEL OR A MILLING-CUTTER DRUM

[75] Inventor: Joseph Allard, Bourg en Bresse, France

[73] Assignee: Eurotungstene, Grenoble, France

[21] Appl. No.: 508,891

[22] Filed: Jun. 29, 1983

[30] Foreign Application Priority Data

Jul. 21, 1982 [FR] France ..... 82 13036

[51] Int. Cl.[3] ..... E21C 35/18

[52] U.S. Cl. ..... 299/91; 403/379; 37/142 A

[58] Field of Search ..... 299/91, 89; 175/413; 403/378, 379; 37/142 A, 142 R

[56] References Cited

U.S. PATENT DOCUMENTS 3,904,247 9/1975 Ostrop ..... 299/91

FOREIGN PATENT DOCUMENTS 512354 of 1952 Belgium ..... 299/91
1350451 of 1963 France ..... 299/91
1498996 of 1967 France ..... 299/91
90086 of 1967 France ..... 299/91
2008170 of 1979 United Kingdom ..... 299/91

*Primary Examiner*—Stephen J. Novosad
*Assistant Examiner*—Mark J. DelSignore
*Attorney, Agent, or Firm*—Oblon, Fisher, Spivak, McClelland & Maier

[57] ABSTRACT

This invention relates to a system for mounting tooth-carrier sectors on a cutter wheel or a milling-cutter drum (or coal-cutter drum) permitting the rapid mounting of the sectors, as well as a change in the direction of operation of the wheel or drum about its axis.

The supports (2) attached to the wheel (1) by their base are delimited by two lateral surfaces (4) and by one upper surface (3), which rest on the yoke-shaped base of the tooth-carrier sectors (8). The support (2) has a shape which is symmetrical with respect to its axis (7), and its lateral surfaces (4) form with the perpendicular to the axis (7) an angle ($\alpha$) which is less than 90° at their outer end. The sector (8) is closed on the side which rests against the front surface (4) during operation.

The sector (8) is attached to its support, for example by means of an elastic dog (11).

6 Claims, 9 Drawing Figures

Figure 3:
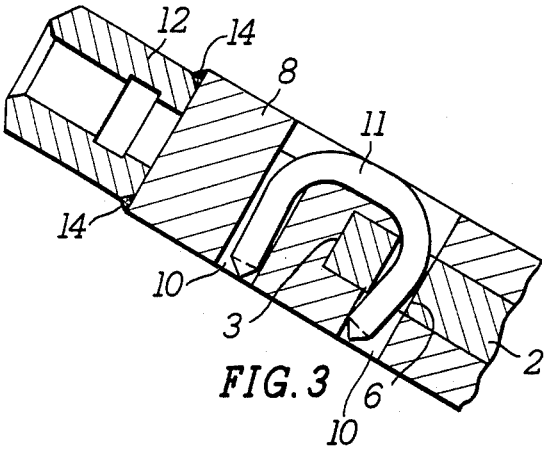

SYSTEM FOR MOUNTING TOOTH-CARRIER SECTORS ON A CUTTER WHEEL OR A MILLING-CUTTER DRUM

This invention relates to a system for mounting tooth-carrier sectors on a cutter wheel or a milling-cutter drum (or a coal-cutter drum), which permits rapid assembly of the sectors, as well as a change in the direction of rotation of work of the wheel or of the drum about its axis.

Tooth-carrier sectors are generally attached to their support either permanently by welding, or detachably by means of pins, bolts etc. However, these systems suffer from the following disadvantages:

the supports are subjected to intensive wear during operation, and it is only possible to work in one direction of rotation.

The device according to the present invention makes it possible to lessen the above-mentioned disadvantages.

This device comprises supports which are fixed (generally at regular intervals) on the periphery of the wheel (or of the drum) and the shape of which is generally elongate in the circumferential direction, delimited by a base, two lateral surfaces and one outer surface. The base is fixed rigidly to the outer surface of the wheel (or of the drum) by welding, by mechanical means or by any other suitable means. This shape is symmetrical with respect to an axis which is at least generally perpendicular to the axis of the wheel (or of the drum). At their outer end, the lateral surfaces form with the perpendicular to the symmetry axis an angle ($\alpha$) of less than 90°. The ends of the lateral surfaces preferably converge more rapidly than the radii which pass through the outer ends of the support. These supports may be pierced by at least two holes or openings which are symmetrical with respect to the radial axis of the support in view of the removable attachment of the tooth-carrier sector by any known means (elastic pin or dog etc.). These two openings may be reduced to a single opening, if it is located on the symmetry axis of the support.

The tooth-carrier sector itself has a base, the cross-section of which through a plane passing through the symmetry axis is in the shape of a yoke which is open in the direction of the base of the support and which engages and rests on the support at its outer part and on one of the lateral surfaces. It is closed at one of the lateral ends, for example by a welded block, and open at the opposite end.

Tooth-carriers are obviously attached to the tooth-carrier sector, according to a known technique. The tooth-carrier sector is provided with holes or openings for its attachment to the wheel (or the drum), in particular being provided with at least one opening complementary to one of the openings made in the support.

The lateral surfaces may have any profile as much in a diametral plane (perpendicular to the axis of the wheel) as in a tangential plane (perpendicular to a radius of the wheel to its outer surface), provided that the condition $\alpha \leqq 90°$ is observed.

The present invention will be understood more clearly from the description of embodiments which are represented in the following Figures.

Figure 1:
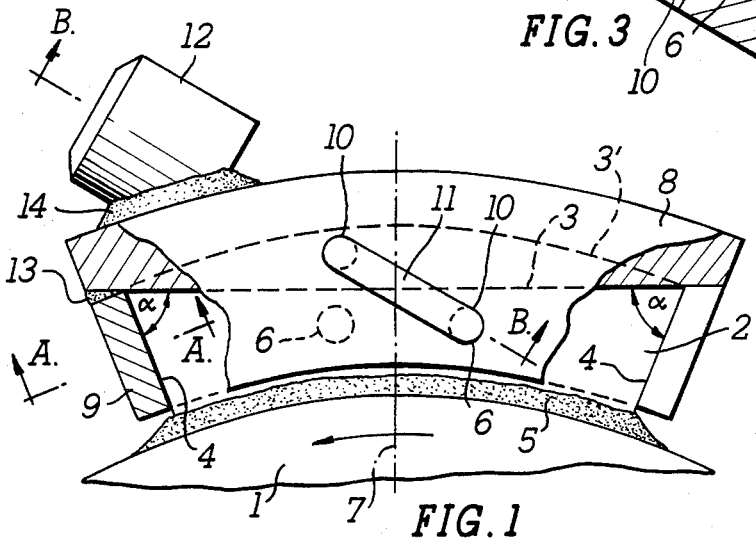
Figure 1A:
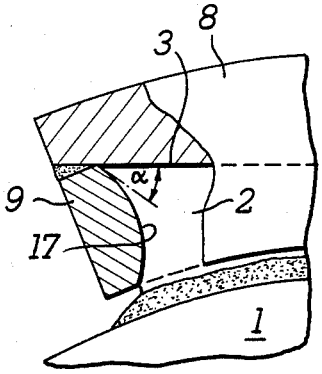
Figure 1B:
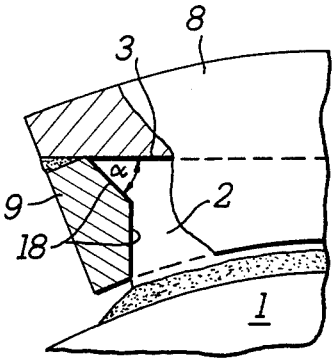
Figure 2:
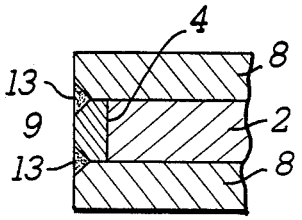
Figure 2A:
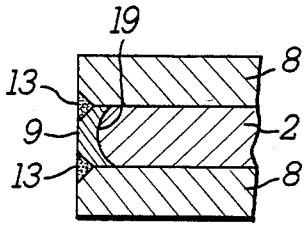
Figure 2B:
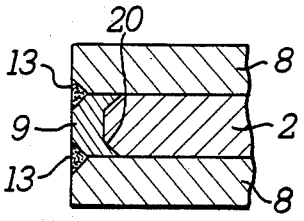
Figure 2C:
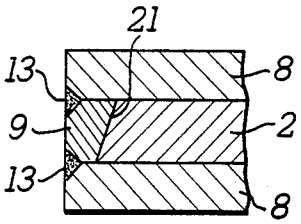
Figure 4:
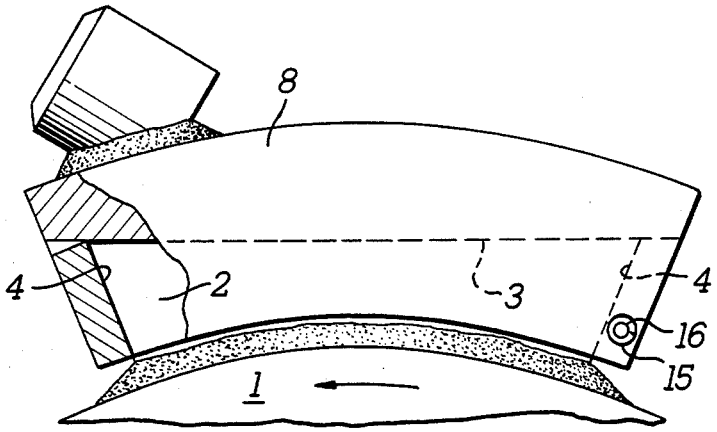

FIG. 1 shows a view of the device in a diametral plane,

FIGS. 1*a* and 1*b* show variants of the lateral supporting surface,

FIGS. 2, 2*a*, 2*b* and 2*c* show various variants of the lateral supporting surface of the support along section AA of FIG. 1, FIG. 3 shows a section of FIG. 1 along line BB, and FIG. 4 shows a view in a diametral plane of another variant of the device.

The arrows in the Figures indicates the direction of rotation of the wheel during operation.

The wheel (1) comprises a support (2) delimited by a flat surface (3) and two lateral surfaces (4) in a radial plane, which is joined to the wheel (1) by a weld (5). The support is provided with two circular holes (6) which are symmetrical with respect to the symmetry axis (7) of the support (2). The tooth-carrier sector (8) comprises a base in the shape of a yoke closed on one side by a welded block (9). The tooth-carrier sector (8) rests on one of the sides (4) of the support (2) as well as on the flat surface (3). The block (9) is attached to the sector (8) by a weld bead (13). The tooth-carrier sector (8) is pierced by two circular holes (10), one of which corresponds to the hole (6) in the support (2), which permits the detachable joinder of the sector (8) to the support (2) by means of an elastic dog (11). The tooth-carrier (12) is attached to the sector (8) by a weld bead (14).

It may easily be seen that the sector (8) may be mounted in one direction or the other on the support (2) by removing the dog (11), turning the sector (8) through 180° about the symmetry axis (7), and replacing the dog (11).

Moreover, the front part of the sector (8) comprising the block (9) forms an effective protection against abrasion for the support (2), which consequently retains its geometry during operation. It should also be noted that the stress due to working is directly supported by the support (2), the dog (11) merely having a function of positioning and joining the sector (8) to the wheel (1).

Accordingly, the dog (11) bears practically no shearing stress.

The surface (3) may differ from a plane and it may have any other configuration which is symmetrical with respect to the axis (7), in particular the configuration of a cylindrical sector, the axis of which coincides with that of the wheel (1), as indicated at (3') in FIG. 1.

The lateral surfaces may have any profile symmetrical to the axis (7), as shown in FIGS. 1*a* and 1*b*, the angle $\alpha$ being $\leqq 90°$.

Likewise, in the tangential direction, the profile of the supporting surfaces (4) is either rounded (19, FIG. 2*a*), or bevelled (20, FIG. 2*b*), or chamfered (21, FIG. 2*c*) and symmetrical with respect to the axis (7).

Of course, as in the case shown in FIG. 4, the attachment of the sector to the support may be assured by a split pin (15) which engages in a hole (16) tangential to the rear supporting surface (4) of the support.

I claim:

1. A cutter wheel or milling-cutter drum comprising:

(a) a wheel which, during use, is rotated about an axis of rotation;

(b) at least one support which is mounted on the outer periphery of said wheel, said support being delimited by a radially outer surface which, in cross-section, is symmetrical with respect to an axis of symmetry which is perpendicular to the axis of rotation of said wheel and two lateral surfaces at opposite ends of said support, said lateral surfaces being symmetrical with respect to said axis of symmetry and being inclined inwardly from said radially outer surface by angles $\alpha$ which are identical and each of which is less than 90°;

(c) a tooth-carrier sector sized and shaped to fit snugly over said at least one support in either of two oppositely disposed positions, said tooth-carrier sector having an abutting surface which is sized and shaped to correspond to said lateral surfaces and which abuts against one of said two lateral surfaces when said tooth-carrier sector is in one of its two oppositely disposed positions and which abuts against the other of said two lateral surfaces when said tooth-carrier sector is in the other of its two oppositely disposed positions;

(d) means for releasably connecting tooth-carrier sector to said support when said tooth-carrier sector is in either of its two oppositely disposed positions; and (e) a tooth-carrier mounted on said tooth-carrier sector, whereby the orientation of said tooth-carrier sector and said tooth-carrier with respect to said axis of rotation can be rapidly reversed, permitting a change in the direction of the rotation of said wheel about said axis of rotation.

2. A cutter wheel or milling-cutter drum as recited in claim 1 wherein each of said angle is $\alpha$ is less than or equal to the angle between a first line which passes through the point of intersection of said radially outer surface and one of said lateral surfaces and which is perpendicular to said axis of symmetry and a second line which passes through the point of intersection of said radially outer surface and one of said lateral surfaces and said axis of rotation.

3. A cutter wheel or milling-cutter drum as recited in claim 1 wherein said means comprise at least two openings in said support which are symmetrical with respect to said axis of symmetry and at least one corresponding opening in said tooth-carrier sector.

4. A cutter wheel or milling-cutter drum as recited in claim 1 wherein said lateral surfaces converge more rapidly than the radii of said wheel which pass through the radially outer ends of said lateral surfaces.

5. A cutter wheel or milling-cutter drum as recited in claim 1 wherein said lateral surfaces are flat.

6. A cutter wheel or milling-cutter drum as recited in claim 1 wherein said lateral surfaces are cylindrical.

* * * * *